US008302342B2

(12) United States Patent
Krieger

(10) Patent No.: US 8,302,342 B2
(45) Date of Patent: Nov. 6, 2012

(54) SYSTEMS AND METHODS FOR CLEANING FIREARM BARRELS

(76) Inventor: John M Krieger, Hartford, WI (US)

( * ) Notice: Subject to any disclaimer, the term of this patent is extended or adjusted under 35 U.S.C. 154(b) by 0 days.

(21) Appl. No.: 12/587,732

(22) Filed: Oct. 13, 2009

(65) Prior Publication Data

US 2011/0083354 A1 Apr. 14, 2011

(51) Int. Cl.
*F41A 31/00* (2006.01)

(52) U.S. Cl. .... 42/95; 15/104.02; 15/104.05; 15/104.16

(58) Field of Classification Search ... 42/95; 15/104.02, 15/104.05, 104.16
See application file for complete search history.

(56) References Cited

U.S. PATENT DOCUMENTS

| | | | | | |
|---|---|---|---|---|---|
| 95,468 | A | * | 10/1869 | Greenfield | 15/104.2 |
| 933,285 | A | * | 9/1909 | Blair | 15/104.16 |
| 1,526,177 | A | * | 2/1925 | Olberding | 15/104.16 |
| 3,205,518 | A | * | 9/1965 | Romaine | 15/104.165 |
| 3,814,525 | A | | 6/1974 | Spencer | |
| 4,407,086 | A | * | 10/1983 | Hasselmann | 42/90 |
| 4,680,824 | A | | 7/1987 | Lieptz | |
| 4,803,792 | A | | 2/1989 | Brown, Jr. et al. | |
| 4,866,871 | A | | 9/1989 | Rivers | |
| 4,930,240 | A | * | 6/1990 | Bice | 42/95 |
| 5,204,483 | A | | 4/1993 | Tellechea | |
| 5,315,778 | A | * | 5/1994 | Wolford | 42/70.11 |
| 5,435,090 | A | * | 7/1995 | Darrow | 42/95 |
| 5,557,871 | A | * | 9/1996 | LaLonde | 42/95 |
| 5,815,975 | A | | 10/1998 | Rambo et al. | |
| 5,934,000 | A | | 8/1999 | Hayes, Sr. | |
| 5,983,550 | A | | 11/1999 | Skaar | |
| 6,269,579 | B1 | | 8/2001 | Warner | |
| 6,672,794 | B2 | * | 1/2004 | Reichborn | 403/325 |
| 6,701,657 | B1 | | 3/2004 | Hudspeth | |
| 7,367,151 | B1 | | 5/2008 | Black et al. | |
| 7,441,363 | B1 | | 10/2008 | Black et al. | |
| 2002/0056219 | A1 | * | 5/2002 | Solberg et al. | 42/95 |
| 2004/0111948 | A1 | | 6/2004 | Schnell | |
| 2007/0261288 | A1 | * | 11/2007 | Perry et al. | 42/95 |
| 2009/0151214 | A1 | | 6/2009 | Williams | |

* cited by examiner

*Primary Examiner* — Michelle Clement
(74) *Attorney, Agent, or Firm* — Ryan Kromholz & Manion, S.C.

(57) ABSTRACT

Embodiments of systems and methods for improved cleaning of a firearm barrel are provided. Generally, a system according to the present invention includes a cleaning head having a cleaning implement coupled to a shank, which provides at least one radial engagement surface and at least one longitudinal engagement surface. The system may further include a cleaning rod adapted to engage the cleaning head in an at least partially overlapping or surrounding engagement. A method according to the present invention includes the steps of inserting a cleaning head into the breech end of a firearm barrel, engaging the head with a cleaning rod, pushing the head through the barrel and retracting the cleaning rod from the barrel, wherein during the retracting step, the head is disengaged from the rod.

17 Claims, 6 Drawing Sheets

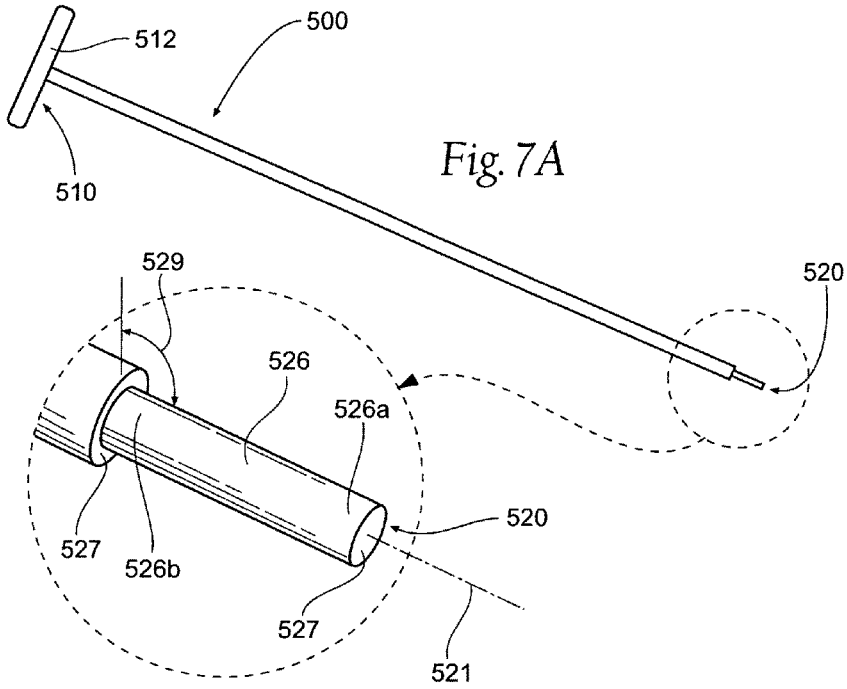
Fig. 7A
Fig. 7B
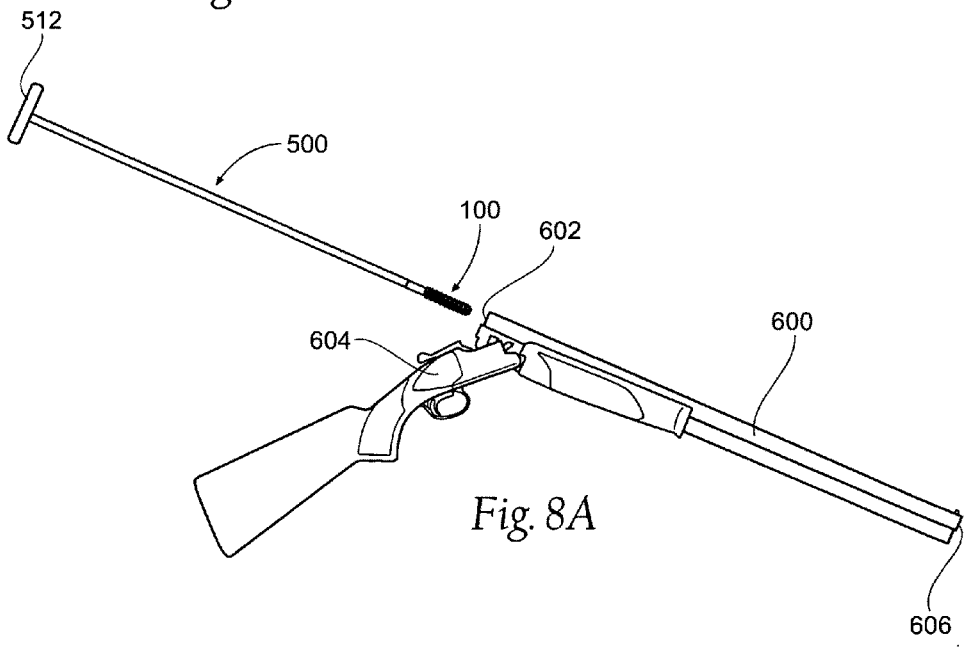
Fig. 8A

SYSTEMS AND METHODS FOR CLEANING FIREARM BARRELS

BACKGROUND OF THE INVENTION

Embodiments of the present invention relate generally to cleaning implements and more particularly to cleaning implements used in cleaning a barrel of a firearm.

Barrel cleanliness is extremely important to firearm users. A clean firearm barrel is a prerequisite to consistent accuracy and also safety. Conversely, barrel obstructions decrease the accuracy of a fired projectile and, in extreme situations, can pose a real safety hazard. While safety is important to all firearm users, accuracy is especially desirable in the field of competitive marksmanship. In the field of competitive marksmanship, a firearm is expected to perform in a consistent manner. To maintain such desirable consistency, a marksman may clean his or her firearm as frequently as after every four or five rounds of ammunition, or even after every round of ammunition, fired through the barrel.

Typically, the barrel of a firearm, or gun, is cleaned by running a rod with an attached cleaning implement, such as a brush, a swab, or a slotted cleaning head with a cloth patch inserted therethrough, from the muzzle end of the barrel to the breech end of the barrel, or vice versa depending on the type of firearm to which the barrel is attached. Sometimes, the cleaning implement is oscillated to and fro through or within the barrel, as if to scrub particulates from the barrel sidewalls. Furthermore, prior cleaning implements may, after having been inserted into the barrel through the muzzle end, be completely or partially withdrawn from the muzzle end before being reinserted completely into the barrel.

Some prior devices have been developed for so-called breech-to-muzzle cleaning of a gun barrel, both for open breech firearms, such as bolt or break action guns, and for closed breech firearms, such as automatic and semi-automatic guns having action and assemblies located near the breech. For instance, Rambo, in U.S. Pat. No. 5,815,975, discloses a breech-to-muzzle cleaning apparatus for use with exposed breech barrels such as those on a break action or lever action firearm, the apparatus including a receptacle for particulates and cleaning patches. Further, Hayes, in U.S. Pat. No. 5,934,000, discloses a pull-through breech-to-muzzle cleaning apparatus for use with semi-automatic or other slide action firearm, such as a pump action.

An open breech firearm was usually cleaned in the following manner. A cleaning implement was placed in a generally longitudinally fixed coaxial arrangement with a cleaning rod, such as by being threadably engaged therewith. The cleaning rod had a handle that swiveled or rotated to allow the rod and attached cleaning implement to rotate to follow the rifling formed into the inside surface of the barrel. Known cleaning implements were brushes, swabs or cloth patches mounted on jags or slotted heads. The implement was usually wetted with a cleaning solvent. While unidirectional cleaning is possible with prior devices, it is extremely cumbersome and time consuming because of the longitudinal fixation of the cleaning implement to the rod.

Although prior devices have been developed for desired barrel cleaning, there remains room for improvement in the art of firearm maintenance for systems and methods for barrel cleaning having a minimized impact on firearm accuracy.

SUMMARY OF THE INVENTION

Embodiments of the present invention include systems and methods for barrel cleaning having a minimized impact on firearm accuracy. It has been discovered that extensive cleaning of a firearm barrel, while thought to maintain consistency and safety, may unexpectedly lead to decreased accuracy if the cleaning procedure is not carried out properly. For instance, it has been found that significant, though largely visibly imperceptible with the naked eye, deformation of the muzzle end, or crown formed therein, of a barrel results from the insertion, especially repeated insertion, of a cleaning implement or a portion thereof, through the muzzle end and into the barrel. The crown is a critical portion of the barrel as far as accuracy is concerned. If the crown is uneven, the high pressure gas that propels a bullet through the barrel will escape unevenly, causing the bullet to oscillate while in its flight path after exiting the barrel, thereby degrading accuracy. The manipulation of a cleaning implement back into the barrel from the muzzle end to the breach end has been discovered to wear the crown unevenly. The wear is thought to be increased where the cleaning implement has been fouled with gun powder and glass powder residue from the cartridge primer from being passed through the barrel from breech to muzzle first.

A firearm barrel cleaning apparatus according to the present invention includes a cleaning head sized to be inserted into the barrel. The cleaning head extends between a first cleaning end and a second control end. The cleaning head includes a cleaning implement coupled to a shank. The shank extends from the control end towards the cleaning end and includes a shank body formed about a shank axis and extending along a shank length. The shank body provides at least one radial engagement surface extending from said control end towards said cleaning end, the at least one radial engagement surface being formed along at least a portion of the shank length at least substantially parallel to the shank axis. The shank body also provides at least one longitudinal engagement surface disposed at an oblique angle with respect to the shank axis. The longitudinal engagement surface may be a substantially planar surface that forms the control end of the cleaning head.

According to an aspect of a cleaning head according to the present invention, the cleaning implement extends from the cleaning end towards the control end.

According to an aspect of a cleaning head according to the present invention, the at least one radial engagement surface extends along a majority of the shank length.

According to an aspect of a cleaning head according to the present invention, the shank body includes a plurality of radial engagement surfaces, at least one of which may be substantially planar.

According to an aspect of a cleaning head according to the present invention, at least one radial engagement surface may be a perimeter of a reentrant bore formed into the shank body from the second control end. The reentrant bore may be formed along a majority of the shank length. A cross-section of the reentrant bore may encompass a mathematical convex set of points, where the cross-section is taken perpendicular to the shank axis. Alternatively or additionally, a cross-section of the reentrant bore may encompass a mathematical concave set of points, where said cross-section is taken perpendicular to the shank axis.

According to an aspect of a cleaning head according to the present invention, the cleaning implement may include a brush. The brush may include a helical frame and a plurality of bristles, which may be formed of brass, extending radially from and supported by the helical frame.

According to an aspect of a cleaning head according to the present invention, the cleaning implement may include a cleaning patch, such as a cotton cleaning patch. In combination with the cleaning patch, the cleaning implement may further include a slotted tip through which the cleaning patch is inserted, or a cleaning jag about which the cleaning patch is disposed.

According to an aspect of a cleaning apparatus according to the present invention, a longitudinal cleaning rod may be provided to engage the cleaning head. The cleaning rod extends between and includes a handle end and a control end. The control end is formed in a mating configuration to the at least one engagement surface provided on the cleaning head.

A method of cleaning a firearm barrel, which has a breech end, a muzzle end and a bore extending therethrough, according to the present invention includes the step of providing a cleaning head including a cleaning implement coupled to a shank and providing a cleaning rod. The cleaning implement, followed by the shank, is inserted into the bore of the firearm barrel from the breech end, thereby establishing a frictional contact between the cleaning implement and the barrel. The shank is then engaged by the cleaning rod, preferably in an at least partially overlapping or surrounding engagement. After engaging the shank with rod, the cleaning implement is pushed at least partially or even completely through the bore towards the muzzle end in a first cleaning direction. After pushing the cleaning implement at least partially through the bore, the cleaning rod is pulled in a second retraction direction, which is at least substantially opposite the cleaning direction. During the pulling step, a first sum of all of a first set of forces acting on the cleaning head in the cleaning direction is greater than a second sum of all of a second set of forces acting on the cleaning head in the retraction direction, thereby causing disengagement of the cleaning rod from the cleaning head.

BRIEF DESCRIPTION OF THE DRAWINGS

FIG. 7A is a perspective view of a first embodiment of a cleaning rod according to the present invention.

FIG. 7B is a magnified view of a portion of the embodiment of FIG. 7A.

FIGS. 8A-8D depict various steps of a cleaning method according to the present invention.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
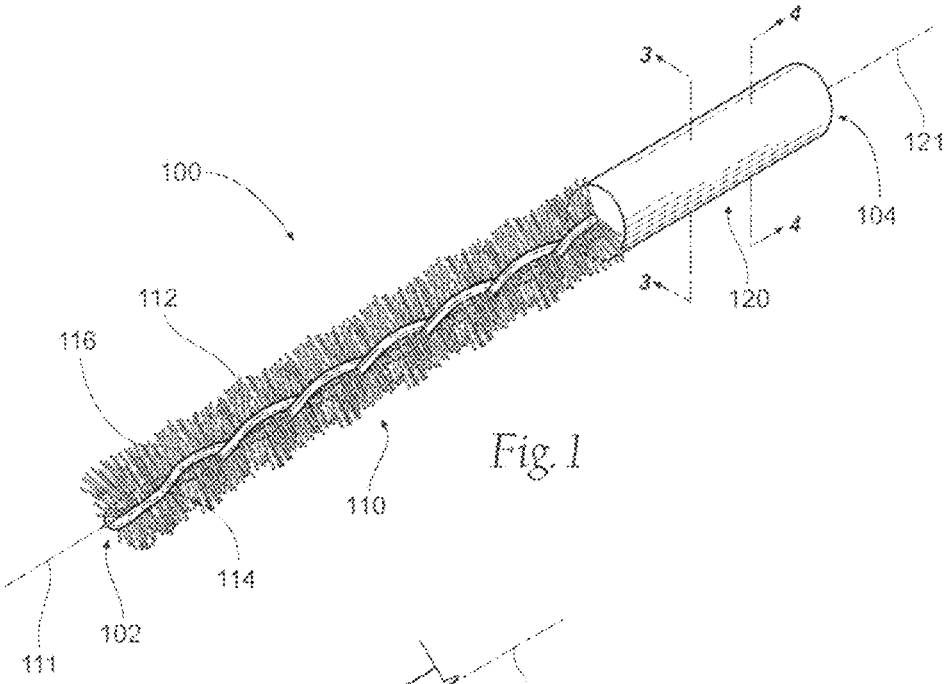
FIG. 1 is a perspective view of a first embodiment of a firearm barrel cleaning head according to the present invention.

Turning now to the figures, FIG. 1 provides an embodiment of a cleaning head 100 according to the present invention. Generally, the cleaning head 100 extends between a first, cleaning end 102 and a second, control end 104. A part of the cleaning head 100 is a cleaning implement 110, which, although it may be disposed between and spaced from the first end 102 and the second end 104, preferably extends from the first end 102 towards the second end 104. Extending from the second end 104 towards the first end 102 is a control shank 120.

The cleaning implement 110 may include a brush 112. Alternatively, the cleaning implement 110 may include a swab or mop (see FIG. 2A), or a cleaning jag (see FIG. 2B) or slotted tip (see FIG. 2C) cooperating with a cleaning patch as are generally known in the art of barrel cleaning. If a brush 112 is provided as the cleaning implement 110, the brush 112 may include a generally longitudinal bristle frame, such as a helical steel or brass wire frame 114. Secured to and supported by the bristle frame 114 is a plurality of bristles 116 extending radially outwardly from the frame 114. The bristles 116 may be formed of a material that is softer than expected firearm barrel material. A preferred material for the bristles 116 is brass. Alternative materials may be used to form the bristles 116, such as phosphor bronze or a resinous plastic material sold under the brand name of Tynex® by E.I. DuPont de Nemours and Company, located at Wilmington, Del.

Figure 2A:
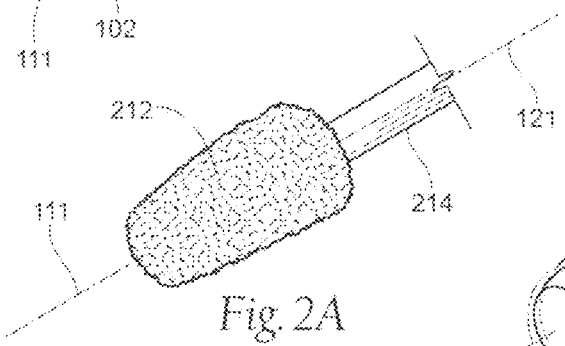
FIG. 2A is a perspective view of a first alternative cleaning implement.
Figure 2B:
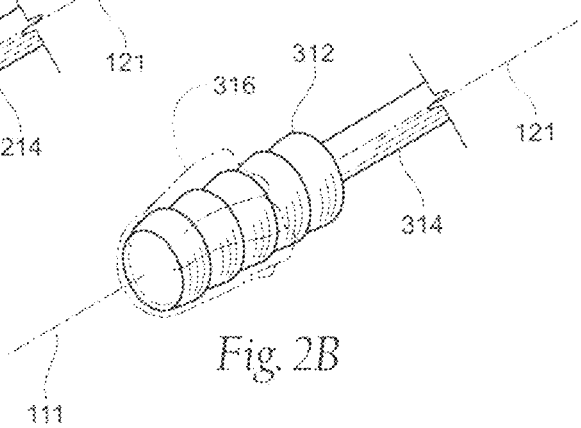
FIG. 2B is a perspective view of a second alternative cleaning implement.
Figure 2C:
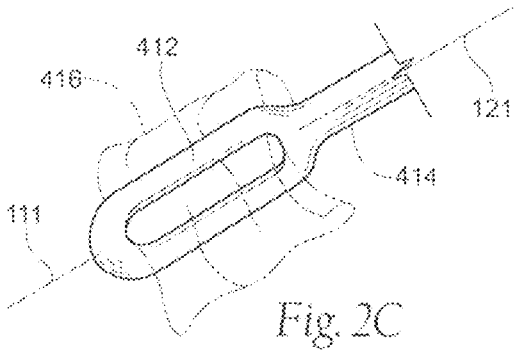
FIG. 2C is a perspective view of a third alternative cleaning implement.
Figure 3:
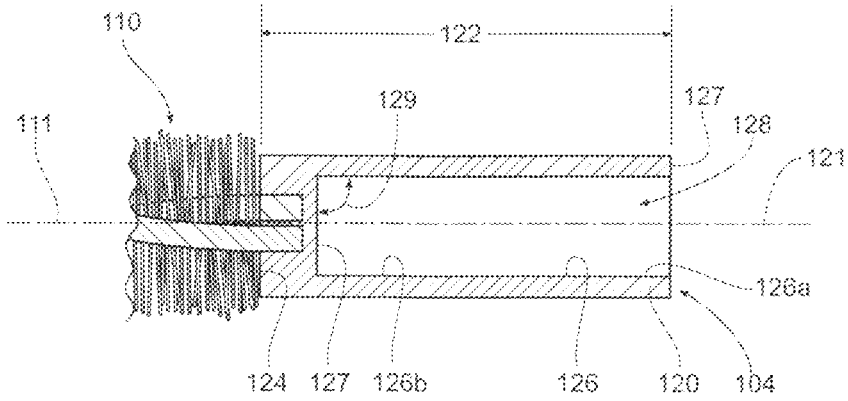
FIG. 3 is a partial cross-section view taken along line 3-3 of FIG. 1.
Figure 4A:
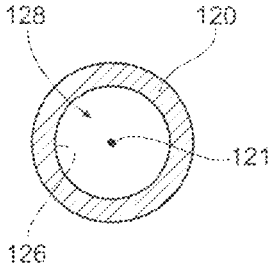
FIG. 4A is a cross-section taken along line 4-4 of FIG. 1.
Figure 4B:
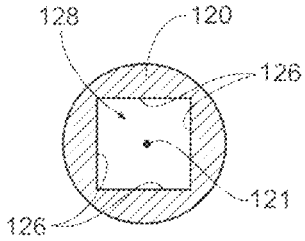
FIG. 4B is a first alternative cross-section taken along line 4-4 of FIG. 1.
Figure 4C:
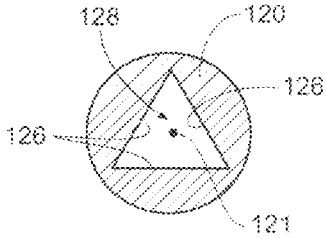
FIG. 4C is a second alternative cross-section taken along line 4-4 of FIG. 1.
Figure 4D:
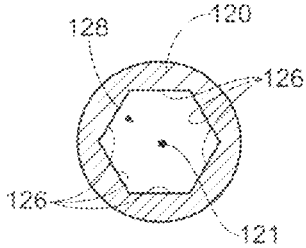
FIG. 4D is a third alternative cross-section taken along line 4-4 of FIG. 1.
Figure 4E:
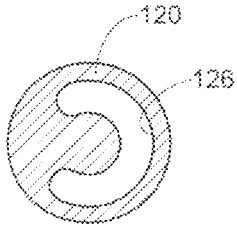
FIG. 4E is a fourth alternative cross-section taken along line 4-4 of FIG. 1.
Figure 5:
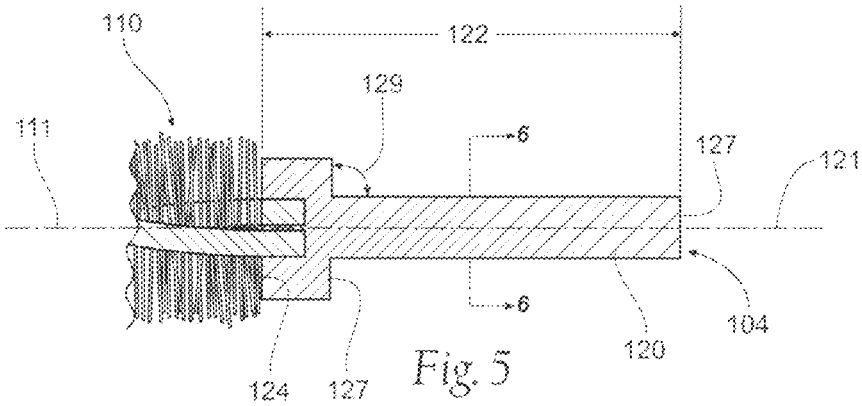
FIG. 5 is a partial cross-section of a first alternative shank according to the present invention.
Figure 6A:
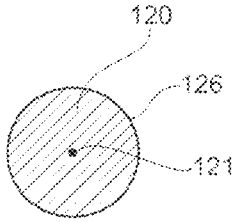
FIG. 6A is a cross-section taken along line 6-6 of FIG. 5.
Figure 6B:
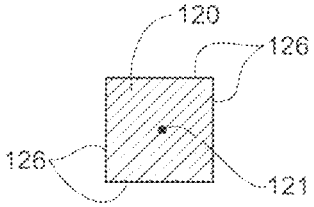
FIG. 6B is a first alternative cross-section taken along line 6-6 of FIG. 5.
Figure 6C:
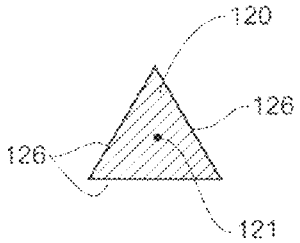
FIG. 6C is a second alternative cross-section taken along line 6-6 of FIG. 5.
Figure 6D:
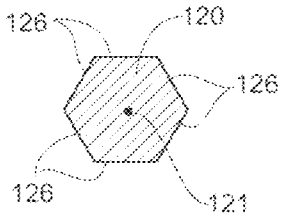
FIG. 6D is a third alternative cross-section taken along line 6-6 of FIG. 5.
Figure 6E:
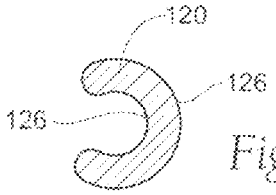
FIG. 6E is a fourth alternative cross-section taken along line 6-6 of FIG. 5.

FIGS. 2A, 2B and 2C depict alternative cleaning implements 110, as mentioned above. FIG. 2A provides an embodiment of a cleaning implement 110 in the form of a swab or mop 212 mounted to a swab support shaft 214, which is then coupled to a shank 120. The swab 212 is preferably a cotton swab and the support shaft 214 is preferably aluminum. FIG. 2B provides an embodiment of a cleaning implement 110 in the form of a cleaning jag 312 supported on a jag shaft 314, which is then coupled to a shank 120, in cooperation with a cotton cleaning patch 316. The jag 312 is preferably made of brass and preferably integrally formed with the jag shaft 314. FIG. 2C provides an embodiment of a cleaning implement 110 in the form of a slotted tip 412 supported on a tip shaft 414, which is then coupled to a shank 120, in cooperation with a cotton cleaning patch 416. The slotted tip 412 is preferably made of brass and preferably integrally formed with the tip shaft 414.

Whichever cleaning implement 110 is utilized, the implement 110 preferably has a longitudinal implement axis 111, which may form an axis of symmetry.

The control shank 120 is preferably formed as a longitudinal body about a shank axis 121. The shank 120 has a shank length 122, which extends from the second end 104 of the cleaning head 100 to a mounting end 124 of the shank 120. Extending along at least a portion, and preferably a majority, of the shank length 122 is at least one radial engagement surface 126, which is formed preferably parallel to the shank axis 121. The shank 120 also preferably includes at least one longitudinal engagement surface 127, which is formed at an oblique angle relative to the shank axis 121. The radial engagement surface(s) 126 may be formed inside the shank 120, as shown in FIG. 3 and FIGS. 4A-4E, such as by forming a portion of a perimeter of a reentrant bore 128 formed into the shank 120 from the second end 104. While it has been stated that the engagement surface(s) 126 are preferably formed at least substantially parallel to the shank axis 121, where an engagement surface 126 is provided inside the shank 120, that surface 126 may slope towards the shank axis 121 from a first point 126*a* on the surface 126 located near the second end 104 to a second point 126*b* on the surface 126 located further from the second end 104 than the first point 126*a*. The reentrant bore 128 may have a cross-section, taken at least substantially perpendicular to the shank axis 121, in which the bore 128 surrounds a mathematical convex set of points, such as those cross-sections shown in FIGS. 3A-3D. Alternatively, the reentrant bore 128 may have a cross-section, taken at least substantially perpendicular to the shank axis 121, in which the bore 128 surrounds a mathematical concave set of points, such as the cross-section shown in FIG. 3E.

Alternatively or additionally, one or more of the engagement surfaces 126 may be formed on the outside of the shank 120, as shown in FIG. 5 and FIGS. 6A-6E. While it has been stated that the engagement surface(s) 126 are preferably formed at least substantially parallel to the shank axis 121, where an engagement surface 126 is provided on the outside of the shank 120, that surface 126 may slope away from the shank axis 121 from a first point 126*a* on the surface 126 located near the second end 104 to a second point 126*b* on the surface 126 located further from the second end 104 than the first point 126*a*.

The longitudinal engagement surface 127 may be the second end 104, or may be provided in addition thereto. If the longitudinal engagement surface 127 is provided in addition to or spaced from the second end 104, the at least one longitudinal engagement surface 127 meets at least one radial engagement surface 126 at preferably an inside angle 129. The longitudinal engagement surface 127 provides a surface adapted to engage a rod longitudinal engagement surface 527, as is described below.

The cleaning implement 110 is coupled to the mounting end 124 of the shank 120, preferably to at least substantially align the implement axis 111 to the shank axis 121. The cleaning implement 110 may be fastened to the shank 120, may be adhered to the shank 120, may be mechanically engaged therewith, such as by threads, or a portion of the cleaning implement 110 may be integrally formed with the shank 120.

While a cleaning head 100 may be simply pushed through a firearm barrel by pushing against the control end 104 thereof, a cleaning rod is preferably provided to engage the cleaning head 100 in an at least partially overlapping or surrounding relationship. FIGS. 7A and 7B depict an embodiment of a cleaning rod 500 according to the present invention. The cleaning rod 500 extends between a control end 510 and a cleaning end 520. Provided at or near the control end 510 is a handle 512, which may be formed in a general T-shape, as shown. The handle 512 may be fixedly mounted on the rod 500, or it may be rotatably mounted on the rod 500, as is known, so as to allow the handle 512 to rotate about the rod axis 521. The cleaning end 520 of the cleaning rod 500 is formed about a rod axis 521 so as to matingly engage at least a portion of the cleaning head shank 120 in an overlapping or surrounding relationship. This overlapping or surrounding relationship may occur in one of two ways: a portion of the cleaning end 520 of the rod 500 may overlap or surround a portion of the shank 120, or a portion of the shank 120 may overlap or surround a portion of the cleaning end 520. One way to accomplish this is a male-female relationship between a portion of the shank 120 and the control end 520 of the cleaning rod 500, with one portion of the relationship (male or female) being provided on the shank 120 and the other portion (female or male) being provided on the rod 500. Regardless of the arrangement, the shank 120 and control end 520 must be sized so as to accommodate preferably frictionless insertion into a predetermined firearm barrel.

In the depicted embodiment 500, the cleaning end 520 includes at least one rod radial engagement surface 526 and at least one rod longitudinal engagement surface 527. The at least one rod radial engagement surface 526 is formed preferably at least substantially parallel to the rod axis 521. The cleaning end 520 also preferably includes at least one longitudinal engagement surface 527, which is formed at an oblique angle relative to the rod axis 521. The radial engagement surface(s) 526 may be formed on the outside of the control end 520, as shown in FIG. 7B. While it has been stated that the engagement surface(s) 526 are preferably formed at least substantially parallel to the rod axis 521, where an engagement surface 526 is provided on the outside of the control end 520, that surface 526 may slope towards the shank axis 521 from a first point 526*a* on the surface 526 located near the cleaning end 520 to a second point 526*b* on the surface 526 located further from the cleaning end 520 than the first point 526*a*.

Additionally or alternatively, the radial engagement surface(s) 526 may form a portion of a perimeter of a reentrant bore (not shown) formed into the cleaning end 520, in a similar fashion to the bore 128 shown with respect to the first cleaning head 100. While it has been stated that the engagement surface(s) 526 are preferably formed at least substantially parallel to the rod axis 521, where an engagement surface 526 is provided inside the cleaning end 520, that surface 526 may slope away from the rod axis 521 from a first point 526*a* on the surface 526 located near the cleaning end 520 to a second point 526*b* on the surface 526 located further from the cleaning end 520 than the first point 526*a*. The reentrant bore (not shown), like the reentrant bore 128 formed into the shank 120, may have a cross-section, taken at least substantially perpendicular to the rod axis 521, in which the bore surrounds a mathematical convex set of points, similar to those cross-sections shown in FIGS. 3A-3D. Alternatively, the reentrant bore may have a cross-section, taken at least substantially perpendicular to the shank axis 521, in which the bore surrounds a mathematical concave set of points, similar to the cross-section shown in FIG. 3E.

The longitudinal engagement surface 527 may be the cleaning end 520, or may be provided in addition thereto. If the longitudinal engagement surface 527 is provided in addition to or spaced from the cleaning end 520, the at least one longitudinal engagement surface 527 meets at least one radial engagement surface 526 at preferably an inside angle 529. The longitudinal engagement surface 527 provides a surface adapted to engage a shank longitudinal engagement surface 127, as is described above.

FIGS. 8A-8F depict various steps in a method of cleaning a firearm barrel 600 according to the present invention. A method according to the present invention generally provides unidirectional firearm barrel cleaning, preferably in the breech-to-muzzle direction. The insertion of a cleaning implement into the muzzle end of a firearm barrel has been discovered to alter accuracy much more than previously thought. In a method according to the present invention, a firearm barrel 600 and a cleaning head 100 are provided. The cleaning head 100 includes a cleaning implement 110 coupled to a shank 120. A cleaning rod 500 is also provided. The cleaning implement 110 is inserted into a breech end 602 of a bore formed in a provided firearm barrel 600, followed by the shank 120. The breech end 602 is the end of the barrel 600 that is, or is adapted to be, positioned closer to the firearm action or firing mechanism 604, and a muzzle end 606 of the barrel 600 is the end of the barrel 600 that is, or is adapted to be, positioned further from the firearm action or firing mechanism 604. The cleaning implement 110 is sized so as to frictionally engage the perimeter of the bore formed in the barrel 600, as is generally now known in the art.

The rod 500 is engaged with the shank 120 on the cleaning head 100. This engagement is preferably an at least partially overlapping or surrounding engagement extending preferably along a majority of the shank length 122. The engagement can be performed prior to or after the insertion of the cleaning implement 110 into the barrel. After the rod 500 and shank 120 are engaged, preferably in the at least partially overlapping or surrounding engagement, the cleaning implement 110 is pushed at least partially through, and preferably completely through, the bore towards the muzzle end 606 of the barrel 600 in a first cleaning direction 701. After the cleaning implement 110 is pushed at least partially through the bore of the barrel 600, the cleaning rod 500 is pulled in a second retraction direction 702, which is at least substantially opposite the first cleaning direction 701.

During the pulling of the rod 500 in the retraction direction 702, a first sum of all of a first set of forces, F(c), acting on the cleaning head 100 in the cleaning direction 701 is greater than a second sum of all of a second set of forces, F(r), acting on the cleaning head 100 in the retraction direction 702. Because F(c) is greater than F(r), the cleaning rod 500 is disengaged from the cleaning head 100. Generally, F(c) may include only frictional force acting on the cleaning head 100 by the barrel 600 or mechanical forces applied to the cleaning head 100, such as by pulling, through the muzzle end 606 of the barrel 600, a string (not shown) fastened to the first end 102 of the cleaning head 100 or by applying, through the breech end 602 of the barrel 600, a pushing force against the second end 104 of the cleaning head 100. Alternatively, F(c) may include both barrel frictional force and force(s) mechanically applied to the head 100. An additional mechanical force may be included in F(c) that is established by the physical abutment of the cleaning implement 110 with the muzzle end 606 of the barrel 600 after the cleaning implement 110 has been pushed partially out of the muzzle end 606 or completely through the barrel 600. Generally, F(r) may include frictional forces caused by contact between the rod 500 and the shank 120 and/or mechanical forces such as desired shank retention forces that may be provided by a spring loaded ball bearing (not shown) included near the cleaning end 520 of the rod 500, where the ball bearing acts in cooperation with the shank 120 to maintain the shank 120 and rod 500 in a mechanical engagement of a desired force.

Figure 8B:
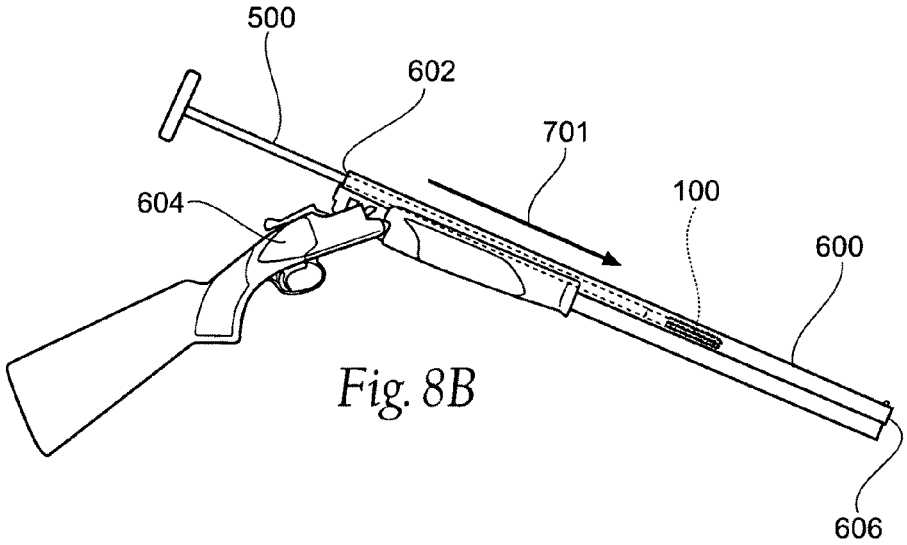
Figure 8C:
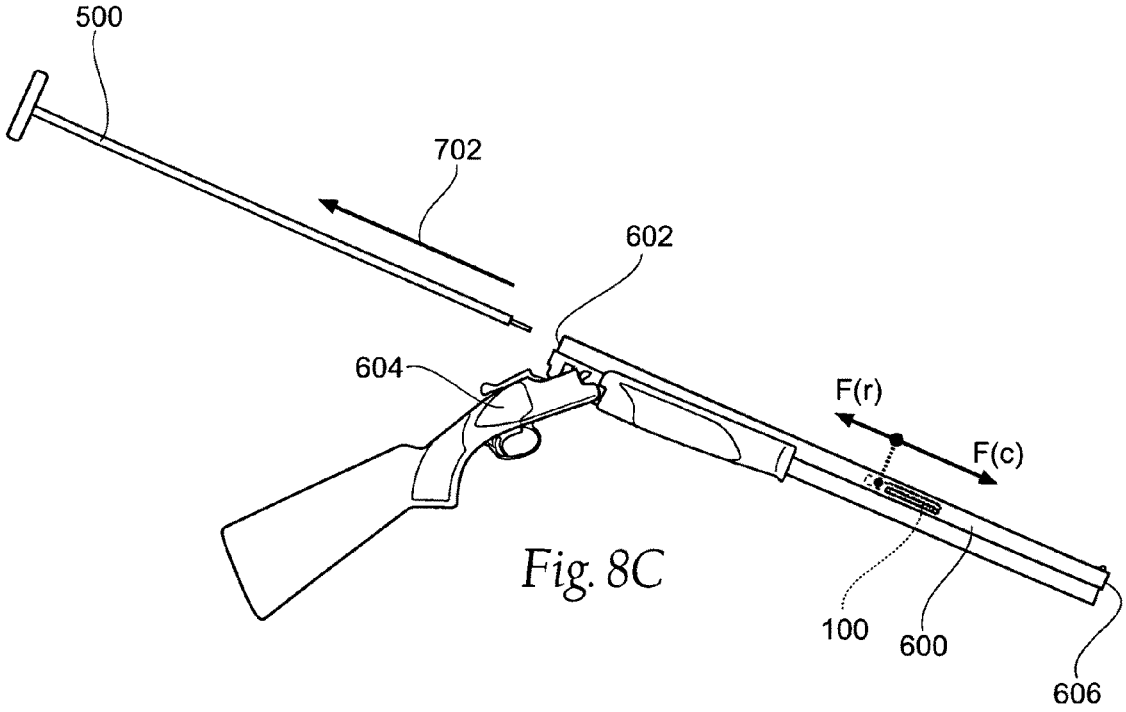
Figure 8D:
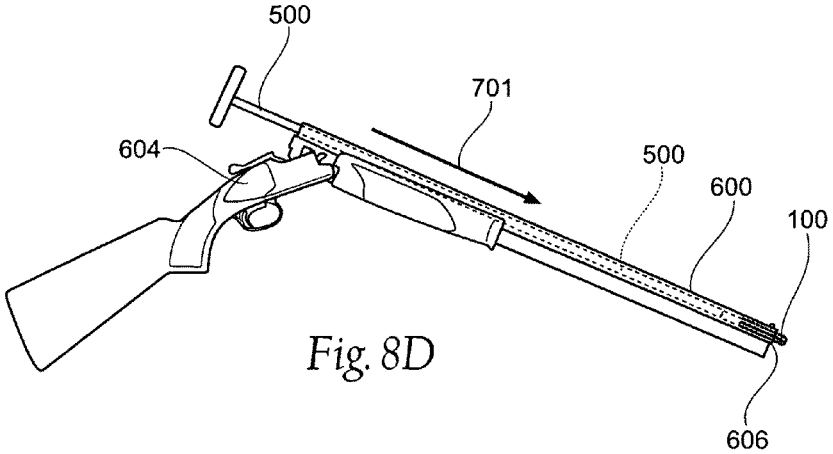
Figure 8E:
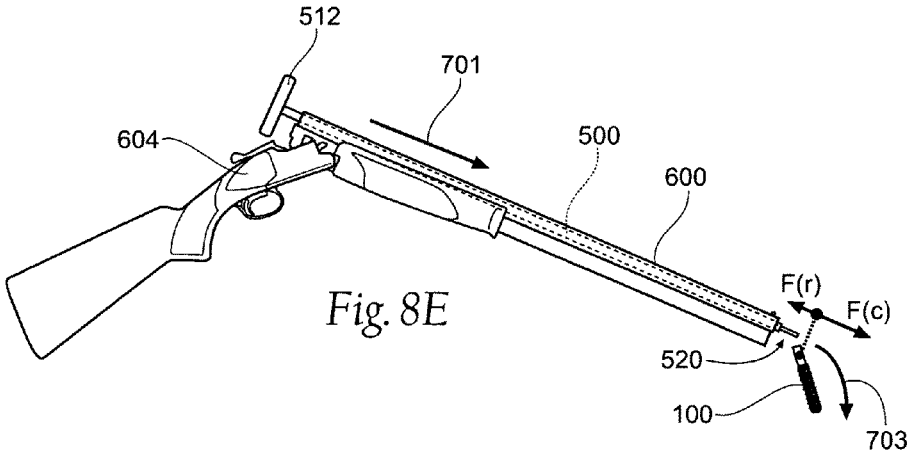
FIG. 8E presents a final step for use in connection with the method of FIGS. 8A-8D.
Figure 8F:
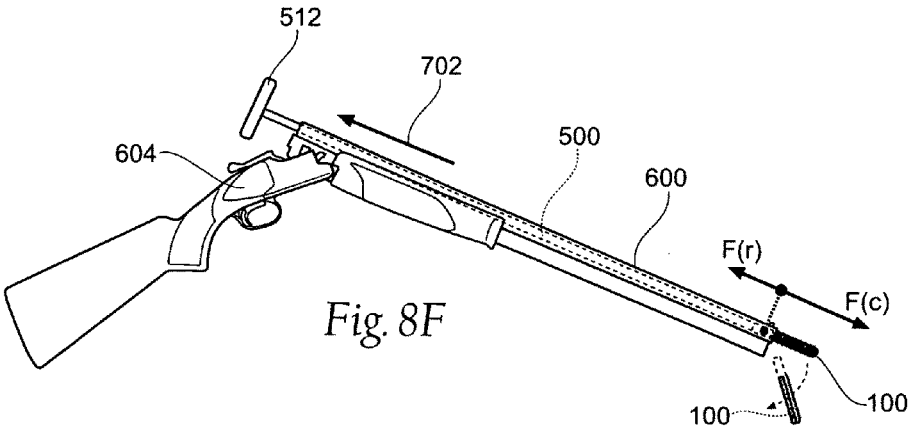
FIG. 8F depicts an alternative final step for use in connection with the method of FIGS. 8A-8D.

In any event, the cleaning head 100 is at least substantially, and preferably completely, prevented from moving in the retraction direction 702 by the forces F(c) acting in the cleaning direction 701 while the cleaning rod 500 is moved in the retraction direction 702. In this manner, the cleaning head 100 is prevented from even accidentally being pulled back across the crown at the muzzle end 606. For instance, as shown in FIG. 8E, the cleaning head 100 may be caused to fall off of the cleaning rod 500 in a release direction 703 simply by the force of gravity. Alternatively, as shown in FIG. 8F, for some reason, the cleaning head 100 may be retained on the cleaning rod 500 against the force of gravity, so the cleaning head 100 may be drawn back against, but not into, the muzzle end 606 of the barrel 600, thereby increasing F(c) greater than F(r) so as to disengage the head 100 from the rod 500.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A firearm barrel cleaning apparatus comprising:

a cleaning head sized to be pushed completely through said barrel, said cleaning head extending between a first cleaning end and a second control end, said cleaning head comprising:

a cleaning implement coupled to a shank, wherein said shank extends from said control end towards said cleaning end, said shank comprising a shank body formed about a shank axis and extending along a shank length, said shank body providing at least one radial engagement surface extending from said control end towards said cleaning end, said radial engagement surface being formed along at least a portion of said shank length at least substantially parallel to said shank axis, and said shank body providing at least one longitudinal engagement surface provided at an oblique angle with respect to said shank axis, wherein at least one longitudinal engagement surface is matingly abuttable with a cleaning rod, wherein said cleaning rod abuts said shank for longitudinal movement to push said cleaning head through, and in only a first axial direction with respect to, said barrel, and further wherein the cleaning head remains longitudinally stationary in said barrel during any longitudinal movement of said cleaning rod in a second axial direction opposite said first axial direction.

2. A firearm barrel cleaning apparatus according to claim 1, wherein said cleaning implement extends from said cleaning end towards said control end.

3. A firearm barrel cleaning apparatus according to claim 1, wherein said at least one radial engagement surface extends along a majority of said shank length.

4. A firearm barrel cleaning apparatus according to claim 1, said shank body providing a plurality of radial engagement surfaces.

5. A firearm barrel cleaning apparatus according to claim 4, wherein at least one radial engagement surface is substantially planar.

6. A firearm barrel cleaning apparatus according to claim 5, wherein all radial engagement surfaces are substantially planar.

7. A firearm barrel cleaning apparatus according to claim 1, wherein said at least one radial engagement surface is a perimeter of a reentrant bore formed into said shank body from said second control end.

8. A firearm barrel cleaning apparatus according to claim 7, wherein said reentrant bore is formed along a majority of said shank length.

9. A firearm barrel cleaning apparatus according to claim 7, wherein a cross-section of said reentrant bore encompasses a mathematical convex set of points, where said cross-section is taken perpendicular to said shank axis.

10. A firearm barrel cleaning apparatus according to claim 7, wherein a cross-section of said reentrant bore encompasses a mathematical concave set of points, where said cross-section is taken perpendicular to said shank axis.

11. A firearm barrel cleaning apparatus according to claim 1, said cleaning implement comprising a brush.

12. A firearm barrel cleaning apparatus according to claim 11, said brush comprising:

a helical bristle frame; and a plurality of bristles extending radially from and supported by said bristle frame.

13. A firearm barrel cleaning apparatus according to claim 12, wherein said bristles are brass.

14. A firearm barrel cleaning apparatus according to claim 1, said cleaning implement comprising a cleaning patch.

15. A firearm barrel cleaning apparatus according to claim 14, said cleaning implement further comprising a slotted tip through which said cleaning patch is inserted.

16. A firearm barrel cleaning apparatus according to claim 14, said cleaning implement further comprising a cleaning jag about which said cleaning patch is disposed.

17. A firearm barrel cleaning apparatus according to claim 1, wherein said longitudinal engagement surface is a substantially planar surface disposed at said control end.

* * * * *